United States Patent [19]

Kamp et al.

[11] Patent Number: 4,807,822

[45] Date of Patent: Feb. 28, 1989

[54] YARN TRAVERSING MECHANISM

[75] Inventors: Heinz Kamp, Wegberg; Rolf Becker; Horst Wionsek, both of Monchen-Gladbach, all of Fed. Rep. of Germany

[73] Assignee: W. Schlafhorst & Co., Fed. Rep. of Germany

[21] Appl. No.: 938,567

[22] Filed: Dec. 5, 1986

[30] Foreign Application Priority Data

Dec. 6, 1985 [DE] Fed. Rep. of Germany ..... 3543131

[51] Int. Cl.[4] ..... B65H 54/32; B65H 54/38

[52] U.S. Cl. ..... 242/43 R; 242/18.1; 242/43 A; 242/158 B

[58] Field of Search ..... 242/43 R, 43 A, 43.1, 242/18.1, 158 B

[56] References Cited

U.S. PATENT DOCUMENTS

| | | | |
|---|---|---|---|
| 1,239,669 | 9/1917 | Colman | 242/43 A |
| 2,238,128 | 4/1941 | Nydegger | 242/43 A |
| 2,662,695 | 12/1953 | Ballard | 242/43 A |
| 3,294,327 | 12/1966 | Horwood | 242/158 B X |
| 3,333,782 | 8/1967 | Beckwith, Jr. | 242/43 A |
| 3,374,961 | 3/1968 | Otsuka et al. | 242/43 A |
| 3,489,359 | 1/1970 | Richter | 242/158 B X |
| 3,491,962 | 1/1970 | Roberts | 242/158 B X |
| 3,565,359 | 2/1971 | Goodhue | 242/158 B X |
| 3,595,494 | 7/1971 | Goodhue | 242/158 B X |
| 3,627,215 | 12/1971 | Richter | 242/158 B X |
| 4,165,047 | 8/1979 | MacKie | 242/43 A |
| 4,349,160 | 9/1982 | Niederer | 242/43 A X |

FOREIGN PATENT DOCUMENTS

| | | | |
|---|---|---|---|
| 2622243 | 12/1977 | Fed. Rep. of Germany | 242/43 A |
| 96546 | 8/1976 | Japan | 242/43 A |
| 139975 | 8/1983 | Japan | 242/43 A |

*Primary Examiner*—Stanley N. Gilreath

*Attorney, Agent, or Firm*—Shefte, Pinckney & Sawyer

[57] ABSTRACT

A yarn traversing mechanism having oppositely traversing yarn engaging elements and transfer means that disengage yarn from one element and transfer it into engagement by an oppositely traversing element at a plurality of different yarn reversing locations at each end of the yarn traverse. The different reversing locations are determined by an unequal spacing of yarn engaging elements and by either selectively raising a yarn guide member or displacing yarn engaging elements differently at different traversals of the yarn.

17 Claims, 5 Drawing Sheets

YARN TRAVERSING MECHANISM

BACKGROUND OF THE INVENTION

The present invention relates to a thread traversing mechanism for cross-winding bobbins and more particularly to a yarn traversing mechanism that has yarn engaging elements that traverse the yarn path in opposite directions and includes means for transferring the traversing yarns from an element traversing in one direction to an element traversing in the opposite direction.

In cross-winding of yarn packages it is important that the yarn be wound as uniformly as possible over the entire traversing area. This is especially difficult in high-speed winding operations, particularly at the ends of the package where the yarn must reverse direction as quickly as possible to minimize any dwell and resulting non-uniform winding. With presently known traversing mechanisms uniform winding with resulting even yarn mass is not easily obtained as the deceleration and reverse acceleration of traverse while the package is constantly rotating produces application of yarn more heavily at the reversing locations at the ends of the traversing area than in the package between the ends regardless of how rapid the reversing occurs, with the result that high-speed wound packages often have an undesirable hyperboloid form.

By the present invention cross-wound packages are produced of desired shape and uniform yarn density or mass relatively inexpensively and at a high winding speed without significant yarn build-up at the ends of the packages that could adversely effect the subsequent use of the package.

SUMMARY OF THE INVENTION

The present invention provides substantially uniform cross-wound packages by reversing the yarn traverse at a plurality of different yarn reversing locations at each end of the traverse so that the build-up of yarn at the reversing locations is dispersed and a concentration of yarn at any location is minimized.

Briefly described, the yarn traversing mechanism of the present invention is utilized in a textile winder for cross-winding textile yarn packages with the mechanism including yarn engaging elements, means for oppositely traversing the elements, and transfer means for disengaging the yarn from one element and transferring it to engagement by an oppositely traversing element for reciprocal traverse of the yarn across the package, with the transfer means operating selectively to transfer the yarn at a plurality of different yarn reversing locations at each end of the yarn traverse. The traversing means operates to oppositely traverse the elements so that they pass each other at different yarn reversing locations at each end of the yarn traverse for transfer of yarn from one element to another at the different reversing locations.

Preferably, the traversing means includes at least one endless band from which the elements project at unequal spacings along the length of the band so that the elements will pass each other for transfer of yarn rapidly with delay at the different reversing locations, such that there is no undesirable yarn build-up in reversing the yarn traverse. In one form, the band is a single band having one reach for traversing elements in one direction and an adjacent reach for traversing the elements in the opposite direction. Preferably, there are three elements projecting from the band with two of the elements spaced apart one-third of the length of the band, and the other spaced less than one-third of the band length from one of the first two and spaced greater than one-third of the band length from the other of the first two elements. In this manner the elements will pass each other for immediate yarn traverse reversal at different reversing locations depending on the spacing between the elements. In another form of the invention there are two separate bands of equal length, each providing one of the oppositely directed reaches, with each preferably having three unequally spaced elements projecting therefrom with the same spacing arrangement mentioned above.

Preferably the transfer means includes a guide member having a yarn guiding surface for guiding the yarn relative to the oppositely traversing yarn engaging elements and serving to separate the yarn from the traversing elements at the reversing locations and to position the separated yarn for engagement by oppositely traversing elements. The relation between the guiding surface and the elements differs for different elements, thereby effecting transfer at different reversing locations. In the preferred embodiment the yarn guiding surface is inclined away from the reversing path of the elements from which the yarn is to be disengaged at the reversing locations for guiding the yarn away from the elements, and the surface is disposed for guiding the yarn in the path of oppositely traversing elements for transferring engagement of the yarn thereby for reverse traverse.

In one embodiment of the present invention, means are also provided for displacing different yarn engaging elements away from the guiding surface at different reversing locations. This may be accomplished by cam means associated with at least some of the yarn engaging elements and with the guide member to effect relative displacement. In this form a cam may be associated with the guide member at the reversing locations and cam followers associated with at least some of the elements and having differing contours to effect displacement of associated elements at different reversing locations. Preferably cam followers are associated with less than all of the yarn engaging elements with the transfer of yarn from elements that do not have associated cam followers occurring at reversing locations different from the locations at which yarn is transferred from elements with which cam followers are associated.

In another embodiment means are provided for displacing the guide member relatively to the traversing path of the yarn engaging elements to cause the guiding surface to separate yarn from the elements at the different reversing locations, with one cam means component associated with the guide member and other cam means components associated with at least some of the yarn engaging elements, with the cam means components associated with the yarn elements interacting with the cam means components associated with the guide member to displace the guide member. In the preferred form of this embodiment the cam means component on the guide member is a contoured groove and the cam means components associated with the yarn engaging elements are projections that project into the groove and are of differing groove engaging extent to effect differing displacement of the guide member and, therefore, transfer of the yarn at different yarn reversing locations. In this form, at least one of the yarn engaging elements has no projection associated with it such that no displacement of the guide member occurs as this yarn engaging element traverses the yarn reversing locations.

In a further embodiment the guide member is pivotable and the means for displacing the guide member pivots the guide member to displace opposite ends of the guiding surface with respect to the path of the yarn engaging elements. This pivoting is preferably intermediate the ends of the guide member with a lever extending from this intermediate location for engagement by pivoting means to cause pivoting of the guide member. The pivoted guide member can be a single integral piece or it can be formed in two separately pivotable parts, each having one opposite yarn traverse end of the guiding surface thereon and each having a lever extending therefrom to cause pivoting by pivoting means that separately engage the levers to displace the guide member parts separately. The pivoting of the guide member or guide member parts is synchronized with the traversing of the elements for proper displacement of the yarn guiding surface in relation to the traversing of the yarn engaging elements to effect reversing of the yarn at the selected reversing locations.

The invention will be explained in more detail and described below with reference made to the schematic embodiments shown in the drawings.

BRIEF DESCRIPTION OF THE DRAWINGS

FIG. 4 is a partial elevational view of the yarn traversing mechanism of FIG. 1 as viewed in the direction of arrow a;

DETAILED DESCRIPTION OF THE PREFERRED EMBODIMENT

Figure 1:
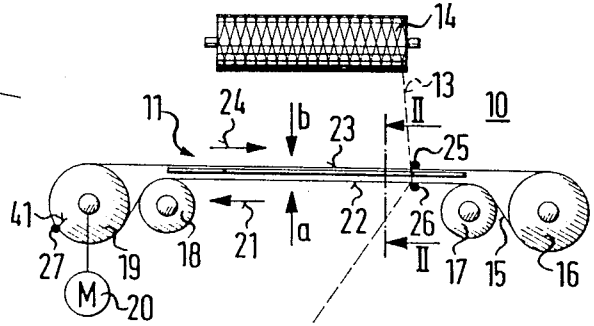
FIG. 1 is a schematic illustration of a yarn traversing mechanism for a textile winder incorporating a preferred embodiment of the present invention.

Referring first to FIG. 1, a textile winder 10 is illustrated diagrammatically and is seen to include a yarn traversing mechanism 11 that traverses a yarn 13 from a supply source 12 and across a package 14 for cross-winding of yarn on the package.

The yarn traversing mechanism 11 includes an endless flexible band that is guided over rollers 16 through 19, with roller 19 being driven by a motor 20. The rollers 16 through 19 guide the band such that it forms a traversing reach 22 extending along the length of the package and through which the band 15 travels in the traversing direction indicated by the arrow 21. The band 15 is also disposed by the rollers to provide a reach 23 adjacent the first reach and also extending along the length of the package for traversing in the opposite direction indicated by the arrow 24 in FIG. 1. The band 15 carries yarn engaging elements 25,26,27 at spaced locations along its length. These yarn engaging elements are indicated in FIG. 1 by large dots for clarity, whereas in FIGS. 4 and 5 the elements are seen as upwardly extending projections of the endless band 15.

The adjacent parallel reaches 21 and 24 of the endless band are approximately one-third the length of the band and there are three yarn retaining elements 25,26,27 that are spaced unequally along the length of the band so that the elements will pass each other at the ends of the reaches at different locations. In this regard, two of the yarn retaining elements 25 and 27 are spaced apart one-third of the circumferential length of the band 15 and the other element 26 is spaced from one element 25 of the first two elements slightly more than one-third the length of the band and from the other element 27 slightly less than one-third the band length. By way of illustration, the difference in spacing from one-third may be approximately 15 millimeters.

In the form of the invention illustrated in FIGS. 1–5 the endless band 15 is arranged in an upright disposition in longitudinal slots 29 and 30 in a stationary supporting member 31.

Figure 4:
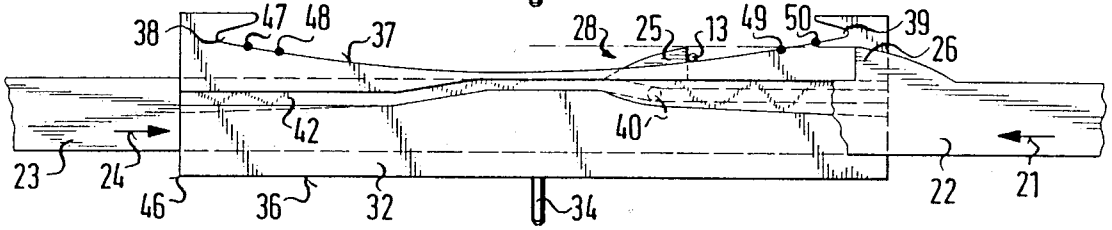
Figure 2:
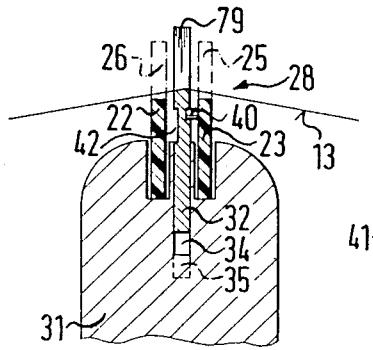
FIG. 2 is a vertical sectional view taken through line II—II in FIG. 1.
Figure 3:
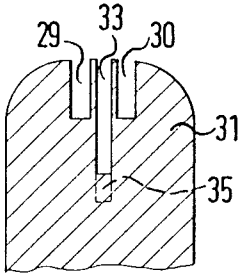
FIG. 3 is a vertical sectional view of the supporting member included in FIG. 2.

In FIGS. 2 and 4 means 28 are illustrated for transferring the yarn 13 from yarn engaging elements in one reach onto yarn engaging elements in the other reach for reversing of the traversal. This is accomplished by disengaging the yarn from a yarn engaging element in one reach and transferring it to engagement by an oppositely traversing element and doing this selectively to transfer the yarn at a plurality of different yarn reversing locations at each end of the yarn traverse. For example, in FIG. 4, yarn engaging element 25 is guiding the yarn 13 as the yarn is approaching a reversal location.

The transfer means 28 includes a board-like guide member 32 that is mounted in a central longitudinally extending slot 33 in the supporting member 31 between the slots 28 and 29 that support the opposite reaches of the band 15. The guide member 32 is supported in a manner that allows it to be pivoted in the slot 33, but not moved longitudinally. To accomplish this, the guide member 32 includes a finger 34 projecting downwardly from the center and received with some tolerance in a corresponding recess 35 extending down in the supporting member 31 from the center of the longitudinal slot 33. As long as no external force acts on the guide member 32, it rests with its lower surface 36 on the bottom of the slot 33.

The guide member 32 has an upper surface formed as a concave guiding surface 37 for guiding yarn 31, with the concave shape causing the yarn 31 to rise toward the outermost ends of traversing so that the yarn, sliding along the guiding surface 37 will be raised from the yarn engaging elements at a reversal location and be transferred for engagement by an oppositely traversing yarn engaging element. When the guide member 32 is resting in the bottom of the slot 33, this reversing location is at the outermost ends 38,39 of the guiding surface 37 where the yarn 13 first slides off one yarn engaging element and is then engaged by an oppositely traversing element for yarn traversal in the opposite direction.

The transfer means 28 also includes means for displacing the guide member 32 relative to the traversing path of the elements to cause the guiding surface 37 to separate the yarn from the elements at different reversing locations. For example, in FIG. 4 the yarn slides on the guiding surface 37 and rises away from the yarn engaging element 25 before reaching the outermost reversing location 39, such as at location 49 where the yarn 13 is then freed to slide into position for engagement by the oppositely traversing yarn engaging element 26.

In the embodiment illustrated in FIGS. 1–4, the displacing means includes cam means associated with at least some elements and with the guide member 32. There is one cam means component on each side of the guide member 32 in the form of a contoured groove 42,43 and there are other components projecting from the band 15 in association with at least some of the yarn engaging elements, with the projections being in the form of pins 40,41 that project into the grooves 42,43. These guide pins 40,41 are disposed above the rollers 16–19 out of interference therewith.

As illustrated in FIGS. 2 and 4 the grooves 42,43 have relatively wide entry ends for receiving the pins with considerable tolerance and without causing displacement. From these entry ends the grooves taper toward a narrow center and then are contoured downwardly to a generally horizontal exit end. Thus, as the band 15 travels horizontally and, thereby carries the pins 40,41 in a horizontal path, the downward contour of the grooves 42,43 will cause the grooves to ride up on the pins and, therefore, cause an upward pivoting of the adjacent portion of the guide member 32.

Figure 5:
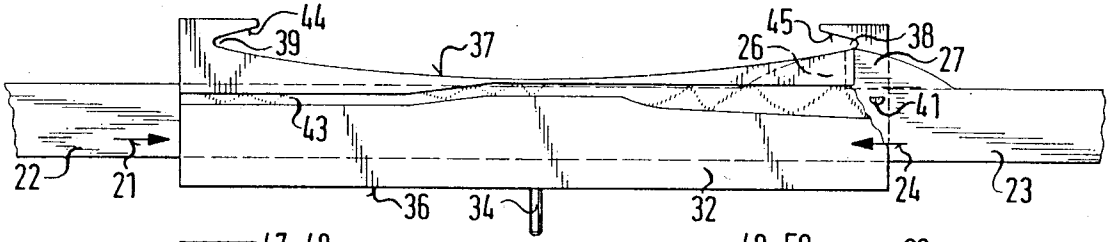
FIG. 5 is a partial elevational view of the yarn traversing mechanism of FIG. 1 as viewed in the direction of arrow b.

The guide members, as illustrated in FIGS. 4 and 5, are formed with yarn retaining projections 44,45 that project inwardly above the outermost ends 38,39 of the yarn guiding surface 37 to prevent the traversing yarn 13 from inadvertently moving out of control by the guide member 32.

In the operation of the yarn traversing mechanism 11 as illustrated in FIGS. 1 through 5, the yarn 13 is traversing from left to right (FIG. 4) and the guide pin 40 of the yarn engaging element 25 has just passed through the downwardly inclined contour of the rear cam groove 43, which raises the groove and causes pivoting of the guide member 32 about its opposite corner 46, with the result that the oppositely traversing yarn engaging element 26 does not project above the guiding surface 37 at the outermost reversal location 39 but rather at an inwardmost location 49, at which the yarn engaging element 25 exiting from the traversing area has passed under the raised guiding surface 37 so that the yarn has been separated therefrom at the reversal location 49 for engagement by the oppositely traversing yarn engaging element 26.

After the element 26 has engaged the yarn 13, the reversal of the yarn traverse occurs with the yarn traveling from right to left (FIG. 4) until the element 26 approaches the outermost reversing location 38, shown at the right in the rear view of FIG. 5. At this time there has been no displacement of the guide member 32 because there is no cam means component or pin associated with the element 26. Thus, the yarn 13 is disengaged from the element 26 by the guiding surface 37 at the outermost reversing location 38 at which it is engaged by the oppositely traversing element 27 and is again traversed in the opposite direction until the element 27 and the element 25 pass each other at a reversing location 50 at the opposite end of the guiding surface 37. The reversing location 50 is intermediate the outermost location 39 and the inwardmost location 49 and is determined by the pin 41 associated with the element 27 being flattened or of lesser extent than the pin 40 that is of greater extent and is associated with the element 25. As a result of this flattened configuration or lesser extent, the guide pin 41 does not raise the guide member 32 to the same extent as did the guide pin 40, with the result that the concave or inclined guiding surface 37 is not raised as high and, therefore, does not separate the yarn from the element 27 until the element has approached closer to the end of the guiding surface 37. At this intermediate yarn reversing location 50 the yarn is transferred to element 25 and is reversely transferred to the inwardmost reversing location 48 at the left (FIG. 4) at which the pin 40 displaces the guide member 32 for yarn transfer thereat to element 26 that traverses the yarn to the right (FIG. 4) with the absence of a pin associated with the element 26 resulting in no displacement of the guide member 32 so that yarn transfer to element 27 occurs at the right (FIG. 4) at the outermost reversing location 39. Element 27 then traverses the yarn to the left (FIG. 4) with the associated pin 41, which is of lesser extent than the pin 40 of the element 25, raising the guide member 32 for transfer of the yarn at an intermediate reversing location 47 at the left (FIG. 4) completing a cycle which is continually repeated.

With this arrangement there are three spaced reversing locations at each end of the yarn traverse, with the yarn continuously alternating between reversal locations and repeating after each six traverses, such that the yarn reversals on the package are alternated between three different locations and a concentration of yarn at any one location is minimized such that an almost homogenous package build-up will result. Other possibilities and variations will be apparent from the present disclosure.

The contour of the guiding surface 37 is illustrated as being concave, but the significance of the contour is that the surface is inclined away from the traversing path of the elements to cause separation of the yarn from the elements at the different reversing locations.

To obtain rapid reversal without undue yarn build-up by delay of the engagement of the yarn by the elements in reversing the transverse, the aforementioned unequal spacing of the elements is arranged so that the trailing element 26 of the two closest spaced elements 27,26 has no cam pin, the trailing element 25 of the two elements 26,25 spaced farthest apart has the cam pin 40 of greatest extent, and the trailing element 27 of the two elements 25,27 spaced apart one-third the band length has the cam pin 41 of the least extent. As the trailing element of each pairing of elements is engaging the yarn as it approaches the reversing locations, its cam pin or absence of a cam pin controls the dislacement of the guide member 32 to determine the location at which the yarn will be transferred to the leading element of the pair as it enters the traversing reach. Thus, the spacing of the elements and the relation of the associated cam pins is such that the elements pass each other at the different reversing locations at which the yarn is being transferred.

Transfer of yarn is also facilitated by the selected steepness of the inclined or concave guiding surface 37 at the reversing locations, as the yarn tends to slide back on the inclined surface after it disengages one element and is about to be engaged by the opposite element.

Figure 15:
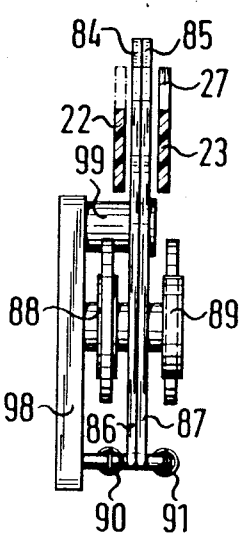
FIG. 15 is a vertical sectional view as viewed from the left in FIG. 14.
Figure 14:
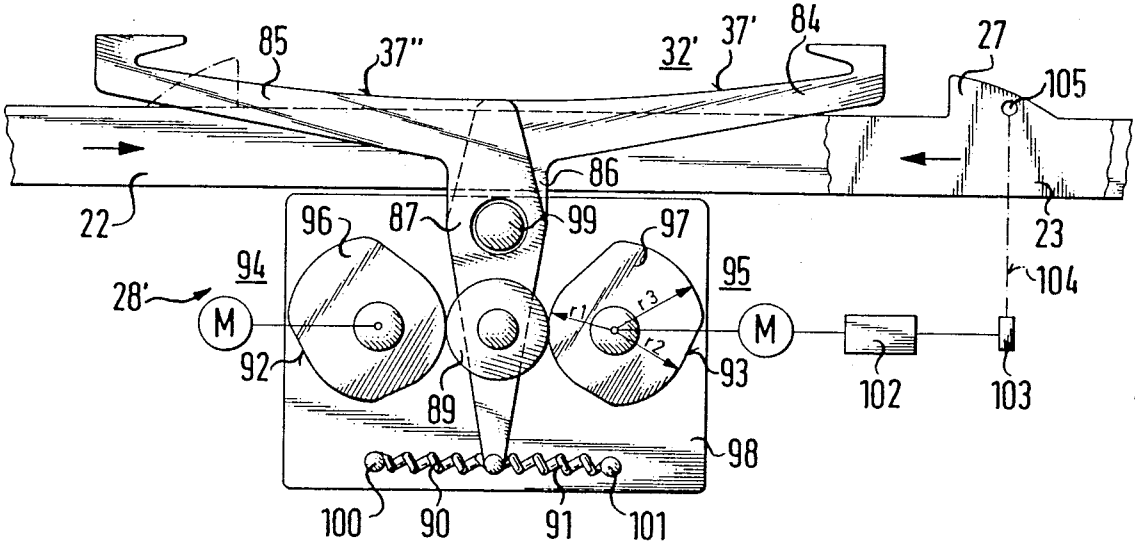
FIG. 14 is a schematic elevational view of a yarn traversing mechanism of the present invention in which the guide member is formed in two separate parts, which are separately controlled.

In the embodiment of the transfer means 28' illustrated in FIGS. 14 and 15, the guide member is pivoted intermediate its ends and is in the form of two separately pivotable parts 84 and 85, each formed with one opposite yarn traverse end of the guiding surface 37' and 37" formed thereon. Each of the guide member parts 84,85 is connected to a guide cam of a cam means that includes a lever 86 extending from the part 84 and a lever 87 extending from the part 85. The lever 86 carries a cam follower roll 88 and the lever 87 carries a cam follower roller 89. The roller 88 follows the coutour of the cam surface 92 of a cam disk 97 of a cam mechanism 94 under the tensioning of a spring 90. Similarly, the cam follower roller 89 is maintained in contact with the cam surface 93 of a cam disk 97 of a cam mechanism 95 by a tension spring 91. Each of the cam surfaces 92 and 93 have portions of three different radii, r1, r2 and r3 for pivoting the guide member parts 84 and 85 to position the guiding surface components 37' and 37" to the three different positions for reversing the yarn at the three reversing locations at each end of the yarn traverse.

The two cam mechanisms 94,95 are mounted on a plate 98 fixed to the frame of the machine, which plate 98 also carries a pivot shaft 99 on which the guide member parts 84 and 85 and the mountings 100 and 101 of the tension springs 90,91 are mounted.

As illustrated in FIG. 14, each of the two cam mechanisms 94,95 can be driven by independent motors M. Alternatively, a single motor could be used to drive both cam mechanisms and to drive the band 15, which would provide automatic synchronization provided the band is driven without slippage, which could be done if the band is a toothed belt. Otherwise, a synchronizing device 102 could be provided to control the motor M, which device could be controlled by a sensor 103, which could be an optical sensor whose axis 104 is directed to an aperture in a yarn engagement element or to a reflector 105 instead of an aperture. In this arrangement every time the aperture or the reflector 105 crosses the optical axis 104 a synchronizing impulse goes to a synchronizing device 102 for control or regulation of the motor M in a manner that causes the motor to run at a selected rpm from one synchronizing impulse to the next.

Another embodiment of the present invention is illustrated in FIGS. 6 through 13, which illustrates a yarn traversing mechanism 51 in place of the mechanism 11 of the embodiment of FIGS. 1–5. In this embodiment the means for oppositely traversing the yarn engaging elements is in the form of two separate endless bands 52,53 that are illustrated as toothed belts. These bands 52,53 are driven at the same speed with the belt 52 (FIG. 6) being driven in the traversing direction indicated by the arrow 54 and the band 53 being driven in the opposite traversing direction indicated by the arrow 55.

As seen in FIGS. 8–13, the rear band 53 is shown above the front band 52 for the sake of clarity, with the front band 52 being trained over rollers 56,57 and the rear band 53 being trained over rollers 58,59. The roller 56 is driven to the left in the direction of arrow 60 and the roller 58 is driven to the right in the direction of arrow 61.

Each of the two bands 52,53 has three yarn engaging elements, elements 1', 2' and 3' on band 53 and elements 1', 2' and 3' on band 52. These three elements on each band are spaced apart at unequal distances, with the distance between two elements, 1 and 3, being one-third of the circumferential length of the band 53 and the other element 2 being spaced more than one-third of the band length from element 1 and less than one-third the band length from the element 3. The same spacing relationship exists with regard to the elements 1', 2' and 3' on the band 52. With this unequal spacing the oppositely traversing elements pass each other at different reversing locations in generally the same manner as described above with regard to the embodiment of FIGS. 1–5.

In the embodiment of FIG. 6–13, the yarn traversing mechanism 51 includes yarn transfer means 62 (FIG. 7) that functions in relation to the timing of the passing of oppositely traversing elements to render the elements inactive or inoperative at such times. For this purpose, the transfer means 62 includes a board-like stationary guide member 4 having a concave yarn guiding surface 5 (FIG. 6) that raises the yarn 13 at the outermost yarn reversing locations 6, 7, to separate the yarn from the element 1' and allow it to be engaged by the oppositely traversing element 2 as the yarn slides on the guiding surface 5.

Figure 8:
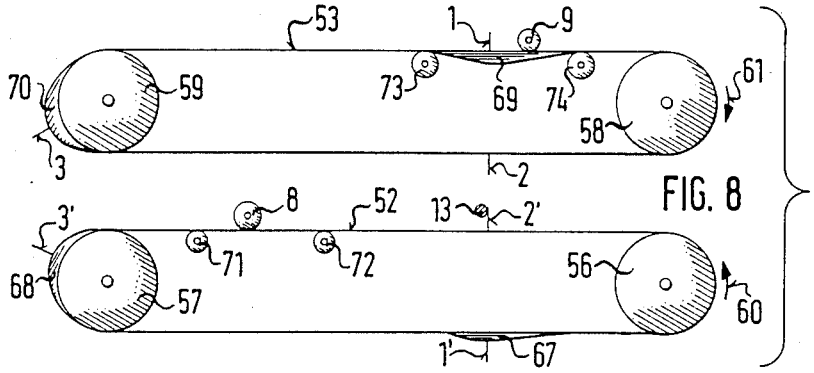
FIG. 8–13 are diagrammatic illustrations of the relation of yarn engaging elements of the yarn traversing mechanism of FIG. 6 shown in different reversing locations.

In this form of the invention the means for creating a displacement between the guide member and the traversing path of the elements causes a movement of selected elements downwardly away from the yarn guiding surface. For this purpose there are enlargements or ramps formed on the bands 52,53 and a stationary cam element in the form of a roller on the guide member 4. As seen in FIG. 8, which is representative of FIGS. 8–13, ramps 67,68 are located adjacent the yarn engaging elements 1',3' of the belt 52 and ramps 69,70 are located adjacent yarn engaging elements 1,3 of the belt 53. These ramps are somewhat longer on the leading side than on the trailing side and are flexible so as to be displaceable as they pass under the stationary rollers 8,9. The stationary roller 8 on the front side of the guide member 4 engages the top surface of the belt 52 and ramps 67,68 so that as the ramps pass under the roller 8 they deflect downwardly and cause downward displacement of the associated yarn engaging element. For this purpose the roller 8 cooperates with two rollers 71,72 spaced to both sides of the roller 8 and engageable with the undersurface of the band 52 to maintain the band and ramps in operating engagement with the roller 8. Similarly, rollers 73,74 are located in the same manner with relation to the roller 9 to support the band 53 on the opposite side of the guide member 4. The rollers 8,9 and the support rollers 71 through 74 are rotatably mounted on stationary frames 75 and 76.

Figure 6:
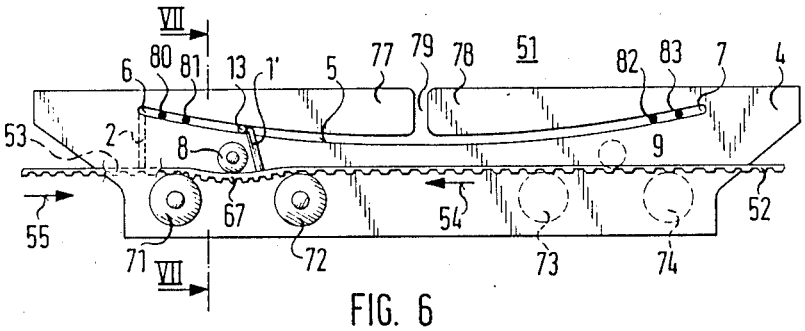
FIG. 6 is a partial elevational view of another embodiment of the yarn traversing mechanism of the present invention.
Figure 7:
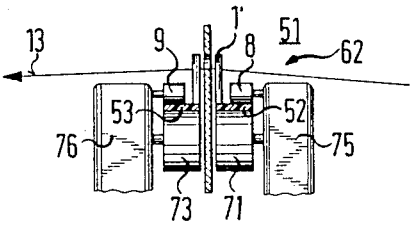
FIG. 7 is a vertical sectional view as viewed along line VII—VII in FIG. 6.

The roller combinations have the function of simply guiding the portions of the bands that do not have ramps formed thereon. However, at the locations at which the ramps are formed, the roller combinations have the function of deflecting the bands downwardly, as shown in FIG. 6.

The guide member 4 has yarn retaining portions 77 and 78 that project over the guiding surface 5 from the outermost ends thereof to a narrow center slot 79 that allows threading of the yarn onto the guiding surface 5.

The operation of this embodiment is illustrated in FIGS. 8–13, in which FIG. 8 illustrates the yarn 13 after it has been transferred at reversing location 82 (FIG. 6) from yarn engaging element 1 to the yarn engaging element 2'. For this purpose the yarn engaging element 1 had been lowered under the guiding surface 5 by its associated ramp 69 running under the roller 9. The yarn 13 now traverses from right to left in the traversing direction 54 (FIG. 6) until the element 2' has reached the position of FIG. 9. There, the passing of the yarn retaining element 3 occurs at the left outermost reversing location 6 (FIG. 6) as there is no ramp associated with element 2' to cause earlier deflection.

Figure 9:
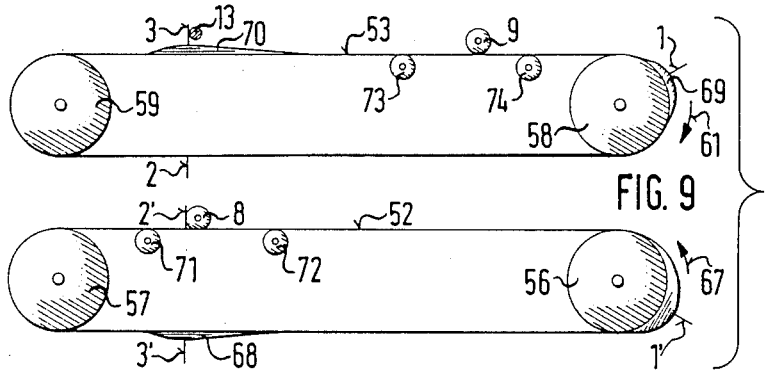
Figure 10:
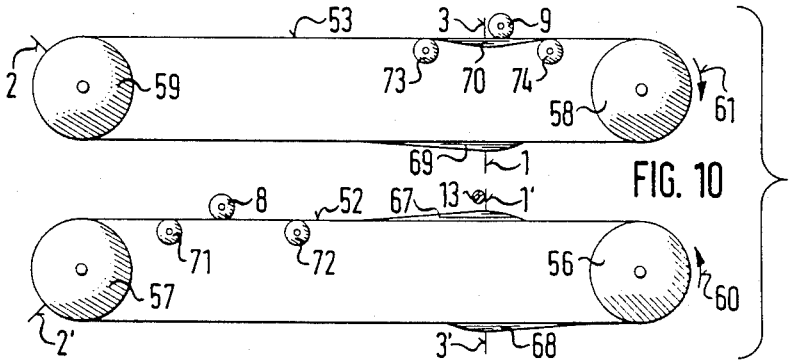

After the element 3 has engaged the yarn 13, as shown in FIG. 9, further yarn traversing occurs from left to right in the opposite traversing direction 55 (FIG. 6) until the element 3 has reached the position of FIG. 10. Its ramp 70 now runs under the roller 9 and the element 3 is, thereby, lowered at the reversing location 83 (FIG. 6). Here, the element 1' engages the yarn 13 again and traverses it from right to left until the element 1' has reached the position shown in FIG. 11. This is the case at reversing location 81 (FIG. 6). The yarn engaging element 1' is already lowered here because its ramp 67 has run under the roller 8.

Figure 11:
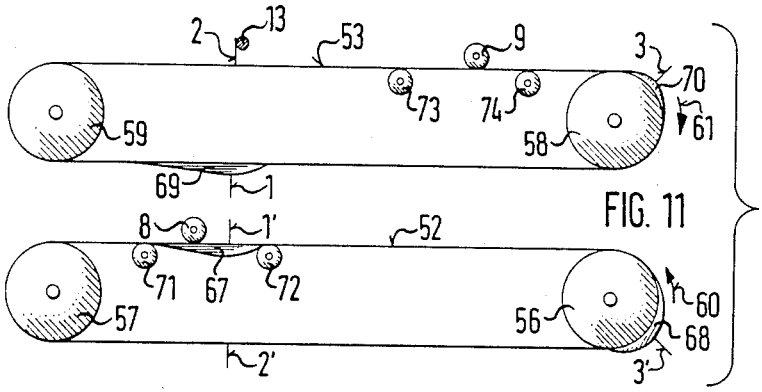
Figure 12:
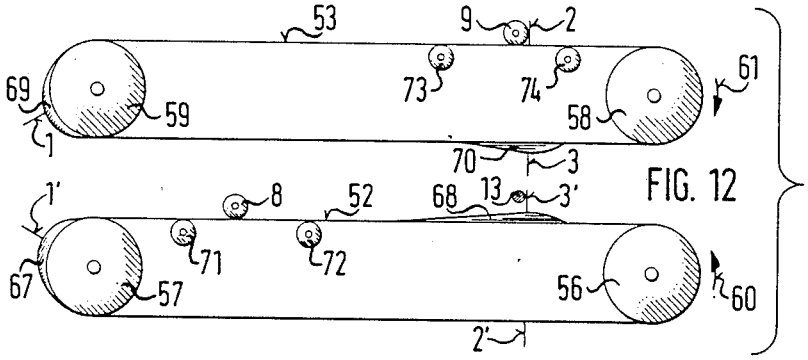
Figure 13:
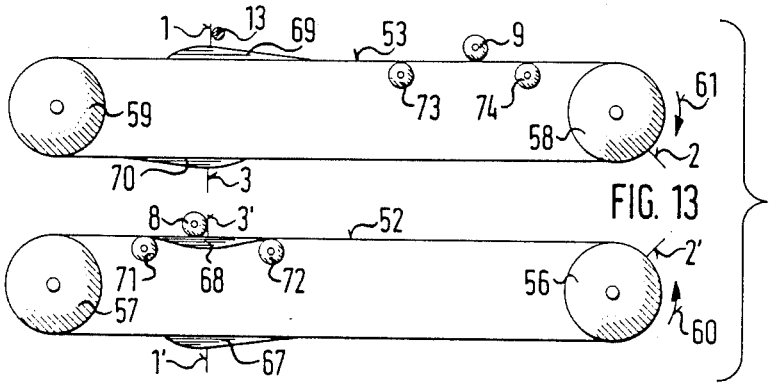

After the element 2 has engaged the yarn 13 at reversing location 81 as illustrated in FIG. 11, further traversing from left to right occurs until the element 2 reaches the position shown in FIG. 12. This is the case at the right outermost reversing location 7 (FIG. 6). At this point, the yarn 13 is engaged by the element 3' as shown in FIG. 12. The yarn 13 now traverses again from right to left until the element 3' has reached the position shown in FIG. 13. It is now at reversing location 80 (FIG. 6). The yarn engaging element 3' has been lowered because its ramp 68 has run under roller 88. The yarn retaining element 1 now traverses the yarn 13 from left to right again until it has reached the position shown in FIG. 8, following which the cycle is repeated. So that the yarn retaining elements can be lowered by the appropriately exact extent at the appropriate reversing locations, the ramps have different thicknesses, with the ramps 67,69 associated with the yarn engaging elements 1',1 being thicker than the ramps 68,70 associated with the yarn engaging elements 3',3. The difference in thickness is not great and can not clearly be shown in the illustrations. In addition, the difference in thickness is a function of the radius or inclination of the guiding surface 5 and of the relative spacing between the reversing locations.

According to a further development of the present invention, the transfer means can comprise mechanical or pneumatic yarn raising means which act on the yarn and raise it from the yarn engaging elements exiting the traversing area. The yarn can be raised from the element by a blast of compressed air, for example. This can also occur by means of a mechanical yarn raiser which can be actuated electromagnetically, for example. The release of the mechanical or pneumatic yarn raising means can occur by detecting the time of the meeting of the elements, whereby a certain lead of the lifting of the yarn can be taken into consideration in order that the yarn transfer might be more secure. The detection of the time of the meeting of the yarn engaging elements can occur, for example, by means of sensors observing the elements or by means of sensing the angle of rotation of the band drive.

A further development of the invention provides that the transfer means includes at least one component mounted on the band for relative engagement by a ramp connected to the yarn engaging element to press the element down into yarn disengaging position. A special yarn guide member may be provided which does not require any contour. Also, the upper edge of the traveling band can function, for example, as the guide contour for the thread. One side of the band acts in a controlling manner on the other side either by lowering the other band side and therewith also its yarn engaging element or by lowering or pivoting the element down against the force of a spring.

The number of selectable reversing locations in the embodiments of the present invention is not limited as the locations can be varied in number and location, and the programming and synchronization of the yarn guide elements may be varied. For example, the movement of the yarn guide elements can be accomplished independently of the speed of the bands, and the frequency of the movement of the yarn guide members may be, for example, only a fraction of the frequency of the yarn traversing. The number of reversing locations is a function of the frequency ratio. By further example, the cam disks 96,97 of the embodiment of FIGS. 14 and 15 may be driven at a slow speed by independent drives, such as geared motors or worm drives. Also, a change in the reversing locations can be effected, if desired, by stopping and restarting the cam disk drive. Further, instead of a cam mechanism, a suitable control mechanism of some other type, e.g. a four-bar mechanism, rocker arm or the like could be used to displace the guide member. Thus, variations can be made in the form, manipulation and control of the various embodiments of the yarn traversing mechanism of the present invention to vary as desired the hardness or softness of the edge portions of the package for preferred package formation.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. A yarn traversing mechanism for a textile winder for cross-winding yarn packages, comprising yarn engaging elements, means for oppositely traversing said yarn engaging elements for alternately engaging the yarn by said oppositely traversing elements to cause the yarn to reciprocally traverse the package, transfer means for disengaging the yarn from one of said elements for transfer to engagement by an oppositely traversing element, said transfer means being operable selectively to transfer the yarn at a plurality of different yarn reversing locations at each end of said yarn traverse and having a guide member with a yarn guiding surface for guiding the yarn relative to a traversing element to separate the yarn and element and to position the separated yarn for engagement by an oppositely traversing element, said yarn engaging elements being relatively disposed for passing each other at said different yarn reversing locations, said yarn guiding surface and said yarn engaging elements being relatively disposed for transfer of yarn at different yarn reversing locations, and said transfer mean including means for displacing different elements away from said guiding surface at different reversing locations.

2. A yarn traversing mechanism according to claim 1 and characterized further in that said means for displacing elements includes cam means associated with at least some of said elements and with said guide member for displacing said at least some elements away from said guide surface at different reversing locations.

3. A yarn traversing mechanism according to claim 2 and characterized further in that said cam means includes a cam associated with said guide member at said reversing locations and cam followers associated with said at least some elements, said cam followers having differing contours to effect displacement of associated elements at different reversing locations.

4. A yarn traversing mechanism according to claim 3 and characterized further in that said yarn guiding surface is inclined away from the traversing path of said elements and the relation of said cam followers and associated elements to said inclined guide surface differs to cause separation of yarn from different elements at different reversing locations.

5. A yarn traversing mechanism according to claim 4 and characterized further in that said cam followers are associated with less than all of said elements for transfer of yarn from elements without cam followers at reversing locations different from the reversing locations at which yarn is transferred from elements with which cam followers are associated.

6. A yarn traversing mechanism for a textile winder for cross-winding yarn packages, comprising yarn engaging elements, means for oppositely traversing said yarn engaging elements for alternately engaging the yarn by said oppositely traversing elements to cause the yarn to reciprocally traverse the package, transfer means for disengaging the yarn from one of said elements for transfer to engagement by an oppositely traversing element, said transfer means being operable selectively to transfer the yarn at a plurality of different yarn reversing locations at each end of said yarn traverse and having a guide member with a yarn guiding surface for guiding the yarn relative to a traversing element to separate the yarn and element and to position the separated yarn for engagement by an oppositely traversing element, and means for displacing said guide member relative to the traversing path of said elements to cause said guiding surface to separate yarn from elements at different reversing locations, said displacing means including cam means having one component associated with said guide member and other components associated with at least some of said elements, said other components interacting with said one component to displace said guide member.

7. A yarn traversing mechanism according to claim 6 and characterized further in that at least one element has no cam means component associated with it.

8. A yarn traversing mechanism according to claim 6 and characterized further in that said one cam means component is a contoured groove formed in said guide member and said other components are projections projecting into said groove.

9. A yarn traversing mechanism according to claim 8 and characterized further in that said projections are of differing groove engaging extent to effect differing displacement of said guide member and transfer of yarn at different reversing locations.

10. A yarn traversing mechanism according to claim 9 and characterized further in that at least one element has no projection associated therewith such that no displacement of said guide member occurs as said element traverses said yarn reversing locations.

11. A yarn traversing mechanism according to claim 10 and characterized further in that said means for oppositely traversing said elements includes at least one endless band from which said elements project with said elements being unequally spaced along said band for passing of oppositely traversing elements at said different reversing locations.

12. A yarn traversing mechanism according to claim 11 and characterized further in that said at least one endless band comprises one endless band having one reach for traversing elements in one traversing direction and an adjacent reach for traversing elements in the opposite traversing direction, and said elements comprise three elements with two elements spaced apart one-third of the length of said endless band and the other element being spaced greater than one-third of the band length from one of said two elements and less than one-third of the band length from the other of said two elements.

13. A yarn traversing mechanism according to claim 12 and characterized further in that the trailing one of the two closest spaced elements has no cam means projection associated with it, the trailing of the two farthest apart elements has a cam projection of the greatest extent and the trailing of the two elements spaced apart one-thid of the length of the band has a cam projection of the least extent.

14. A yarn traversing mechanism for a textile winder for cross-winding yarn packages, comprising yarn engaging elements, means for oppositely traversing said yarn engaging elements for alternately engaging the yarn by said oppositely traversing elements to cause the yarn to reciprocally traverse the package, transfer means for disengaging the yarn from one of said elements for transfer to engagement by an oppositely traversing element, said transfer means being operable selectively to transfer the yarn at a plurality of different yarn reversing locations at each end of said yarn traverse and having a guide member with a yarn guiding surface for guiding the yarn relative to a traversing element to separate the yarn and element and to position the separated yarn for engagement by an oppositely traversing element, and means for displacing said guide member relative to the traversing path of said elements to cause said guiding surface to separate yarn from elements at different reversing locations, said guide member being pivotable and said displacing means pivoting said guide member to displace the opposite ends of said guiding surface.

15. A yarn traversing mechanism according to claim 14 and characterized further in that said guide member is pivoted intermediate its ends and has a lever extending therefrom, and said displacing means engages said lever to pivot said guide member.

16. A yarn traversing mechanism according to claim 15 and characterized further in that said guide member is formed in two separately pivotable parts, each having one opposite yarn traverse end of the guiding surface thereon and each having a lever extending therefrom, and said pivoting means separately engaging said levers to displace said guide member parts separately.

17. A yarn traversing mechanism according to claim 15 and characterized further in that said pivoting means operation is synchronized with the traversing of said elements.

* * * * *